US008186605B2

(12) United States Patent
Facchin

(10) Patent No.: US 8,186,605 B2
(45) Date of Patent: May 29, 2012

(54) FLUID INJECTOR

(75) Inventor: Alessandro Facchin, Pisa (IT)

(73) Assignee: Continental Automotive GmbH, Hannover (DE)

( * ) Notice: Subject to any disclaimer, the term of this patent is extended or adjusted under 35 U.S.C. 154(b) by 214 days.

(21) Appl. No.: 12/729,329

(22) Filed: Mar. 23, 2010

(65) Prior Publication Data

US 2010/0264229 A1 Oct. 21, 2010

(30) Foreign Application Priority Data

Mar. 23, 2009 (EP) ..... 09004139

(51) Int. Cl.
*F02D 1/06* (2006.01)

(52) U.S. Cl. ..... 239/5; 239/585.1; 239/585.4; 239/900; 251/129.16

(58) Field of Classification Search ..... 239/900, 239/5, 585.1–585.5; 251/129.16, 129.21
See application file for complete search history.

(56) References Cited

U.S. PATENT DOCUMENTS

| | | | | |
|---|---|---|---|---|
| 5,979,786 | A * | 11/1999 | Longman et al. | 239/585.5 |
| 6,510,841 | B1 * | 1/2003 | Stier | 239/585.3 |
| 6,796,511 | B2 | 9/2004 | Hohl | 239/5 |
| 6,892,966 | B2 | 5/2005 | Keim | 239/533.2 |

FOREIGN PATENT DOCUMENTS

| | | |
|---|---|---|
| DE | 19948238 | 4/2001 |
| EP | 1801409 | 6/2007 |
| FR | 2194888 | 3/1974 |
| WO | 0157392 | 8/2001 |
| WO | 0212714 | 2/2002 |

OTHER PUBLICATIONS

European Search Report and Written Opinion for Application No. 09004139.3 (7 pages) Nov. 2, 2009.

* cited by examiner

*Primary Examiner* — Steven J Ganey
(74) *Attorney, Agent, or Firm* — King Spalding L.L.P.

(57) ABSTRACT

A fluid injector has a valve body with a recess in which a valve needle is arranged axially movable preventing a fluid flow and being mechanically coupled to an axial end of a first spring preloaded to exert a force on the valve needle. A first armature is mechanically coupled to the valve needle. A second armature is arranged in the recess axially movable away and towards a protrusion of the valve body mechanically coupled to an axial end of a second spring preloaded exerting a force on the second armature which is arranged and designed such that from a closing to a first given position, the first and second armature are mechanically decoupled, and from the first given position further away from the closing position, the first and second armature are mechanically coupled. A solenoid drive magnetically actuates the first and second armature to move axially.

17 Claims, 3 Drawing Sheets

FLUID INJECTOR

CROSS-REFERENCE TO RELATED APPLICATIONS

This application claims priority to EP Patent Application No. 09004139 filed Mar. 23, 2009, the contents of which is incorporated herein by reference in its entirety.

TECHNICAL FIELD

The invention relates to a fluid injector.

BACKGROUND

Increasingly stringent rules concerning the admissibility of noxious emissions from internal combustion engines which are arranged in vehicles render it necessary to take various measures which reduce the emissions.

One way to reduce these emissions is to improve the combustion process in the internal combustion engine. This may be achieved by a precise dosing of fluid into a combustion chamber of the internal combustion engine. In particular for small quantities of fluid the precise dosing is a challenge.

SUMMARY

According to various embodiments, a fluid injector can be provided which enables a precise dosing of the fluid.

According to an embodiment, a fluid injector may comprise a valve body having a recess; a valve needle being arranged axially movable in the recess preventing a fluid flow out of an injection nozzle which extends away from the recess in a closing position and enabling the fluid flow of the injection nozzle apart from the closing position and being mechanically coupled to an axial end of a first spring which is preloaded to exert a force on the valve needle towards the injection nozzle; a first armature being mechanically coupled to the valve needle; a second armature being arranged in the recess axially movable away and towards a protrusion of the valve body, the second armature being mechanically coupled to an axial end of a second spring which is preloaded to exert a force on the second armature, the second armature being arranged and designed such that from a closing position of the valve needle towards a first given position away from the closing position the first armature and the second armature are mechanically decoupled, and from the first given position on, further away from the closing position, the first armature and the second armature are mechanically coupled; and a solenoid drive being designed and arranged to magnetically actuate the first armature and the second armature to move axially.

According to a further embodiment, at least one further armature can be arranged in the recess axially movable away and towards a respective further protrusion of the valve body, being mechanically coupled to an axial end of a respective further spring which is preloaded to exert a force on the at least one further armature, being arranged and designed such that from a closing position of the valve needle towards a respective further given position away from the closing position the first armature and the respective further armature are mechanically decoupled, and from the respective further given position on, further away from the first given position, the respective further armature and the first armature are mechanically coupled. According to a further embodiment, an adjusting tube can be arranged in the recess and being designed to preload the first spring, the second spring and the respective further spring by a mechanical coupling. According to a further embodiment, a multitude of adjusting tubes may equal the number of springs and may be arranged concentrically in the recess at a respectively given adjusting tube position such that each adjusting tube preloads a respective spring.

BRIEF DESCRIPTION OF THE DRAWINGS

Exemplary embodiments are shown in the following with the aid of schematic drawings. The Figures are illustrating.

Elements of the same design or function are referred to by the same numerals.

DETAILED DESCRIPTION

Figure 1:
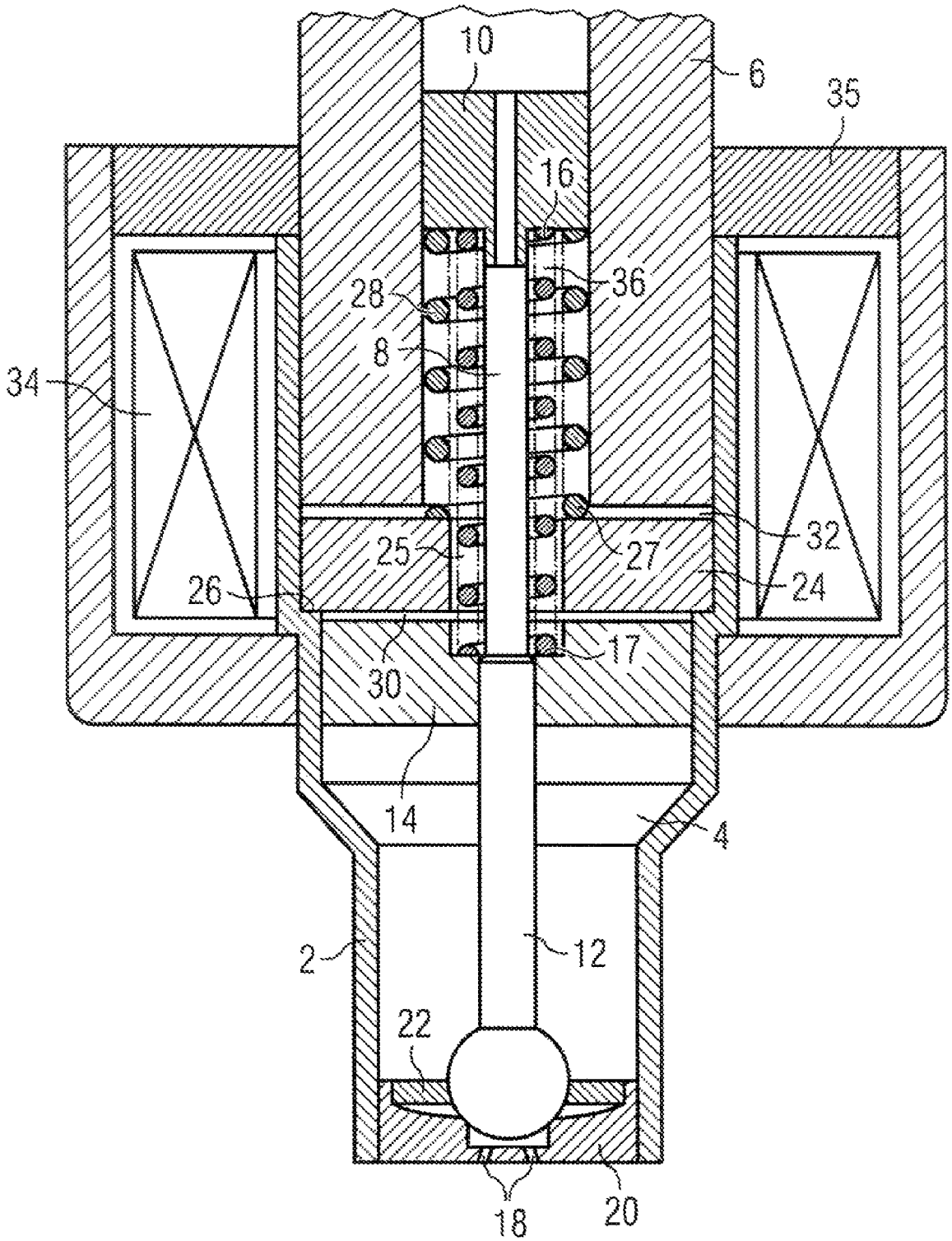
FIG. 1 a fluid injector.

According to various embodiments, a fluid injector may comprise a valve body with a recess and a valve needle being arranged axially moveable in the recess. In a closing position of the valve needle a fluid flow out of an injection nozzle which extends away from the recess is prevented and apart from the closing position the fluid flow through the injection nozzle is enabled. The valve needle is mechanically coupled to an axial end of a first spring which is preloaded to exert a force on the valve needle towards the injection nozzle. A first armature is mechanically coupled to the valve needle. A second armature is arranged in the recess axially moveable away and towards a protrusion of the valve body. The second armature is mechanically coupled to an axial end of a second spring which is preloaded to exert a force on the second armature. The second armature is arranged and designed such that from a closing position of the valve needle towards a first given position away from the closing position, the first armature and the second armature are mechanically decoupled, and from the first given position on, further away from the closing position, the first armature and the second armature are mechanically coupled. The fluid injector further comprises a solenoid drive which is designed and arranged to mechanically actuate the first armature and the second armature to move axially.

This enables a precise dosing of fluid through the injection nozzle by an actuation of the valve needle with a precisely determined lift given by the distance between the closing position and the first given position of the valve needle.

In an embodiment, at least one further armature is arranged in the recess being axially moveable away and towards a respective further protrusion of the valve body. The at least one further armature is mechanically coupled to an axial end of a respective further spring which is preloaded to exert a force on the at least one further armature. The at least one further armature is arranged and designed such that from the closing position of the valve needle towards a respective further given position away from the closing position, the first armature and the respective further armature are mechanically decoupled, and from the respective further given position on, further away from the first given position, the respective further armature and the first armature are mechanically coupled.

This enables a precise dosing of fluid through the injection nozzle with the possibility to drive the valve needle in a respective further opening position and such to increase the possible number of dosing intensities.

According to a further embodiment, an adjusting tube is arranged in the recess being designed to preload the first spring, the second spring, and the respective further spring by a mechanical coupling. This allows a simple preload of the first spring, the second spring, and the respective further spring by a mechanical coupling. In particular, for the closing position of the valve needle, the force which is exerted by the first spring is lower than the force which is exerted by the second spring. This means that the preload of the first spring is lower than the preload of the second spring.

According to a further embodiment, a multitude of adjusting tubes which equals the number of springs is arranged concentrically in the recess at a respective given position such that each adjusting tube preloads a respective spring. This enables easily to give the preload individually for the first spring, the second spring and the respective further spring.

A fluid injector (FIG. 1) that is in particular suited for dosing fuel into an internal combustion engine comprises a valve body 2 having a recess 4. The fluid injector further comprises an inlet tube 6 having a cavity 8 in which an adjusting tube 10 is arranged. A valve needle 12 is arranged in the recess 6 being mechanically coupled to a first armature 14. A first spring 16 is arranged in the recess 4 of the valve body 2 and/or the cavity 8 of the inlet tube 6. The first spring 16 is mechanically coupled to the valve needle 12 at an axial end 17 of the first spring 16. The adjusting tube 10 forms a further seat for the first spring 16 and may, during the manufacturing process of the fluid injector, be axially moved in the inlet tube 6 in order to preload the first spring 16 in a desired way. The result is that the first spring 16 exerts a force on the valve needle 12 towards an injection nozzle 18 of the fluid injector.

In a closing position of the valve needle 12, it sealingly rests on a seat 20 and prevents a fluid flow through the at least one injection nozzle 18. The injection nozzle 18 may, for example, be an injection hole. It may, however, also be of some other type suitable for dosing fluid. Furthermore, there can be a multitude of injection nozzles 18 (FIG. 1). In the following, it will be referred to one injection nozzle 18 in regard to the possibility that there can be several injection nozzles 18. The seat 20 may be made in one part with the valve body 2 or may also be a separate part of the valve body 2. In addition to that, preferably a lower guide 22 for guiding the valve needle 12 can be provided. Further, a second armature 24 with a cavity 25 is arranged in the recess 4 of the valve body 2. The second armature 24 is axially moveable away and towards a protrusion 26 of the valve body 2.

The second armature 24 is mechanically coupled to an axial end of a second spring 27 which is preloaded between the second armature 24 and the adjusting tube 10 in order to exert a force on the second armature 24. The preload of the second spring 28 is bigger than the preload of the first spring 16.

The first armature 14, the second armature 24, and the protrusion 26 are arranged and designed such that when the second armature 24 is mechanically coupled to the protrusion 26, there is a first gap 30 of a given size between the first armature 14 and the second armature 24. Furthermore, there is a second gap 32 of a further given size between the second armature 24 and the inner tube 6. In an embodiment the first gap 30 is smaller than the second gap 32.

The fluid injector is provided with a solenoid drive 34 which is arranged in a housing 35. The housing 35 is arranged partially around the valve body 2. Preferably, the solenoid drive 34 may be an electromagnetic drive, comprising a coil which can be preferably overmolded. The housing 35, the inner tube 6, the first armature 14 and the second armature 24 form an electromagnetic circuit together with the valve body 2.

Figure 2A:
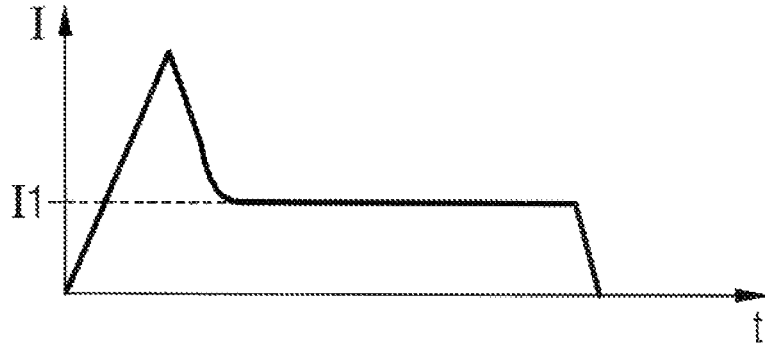
FIGS. 2A and 2B driving currents of the fluid injector.
Figure 2B:
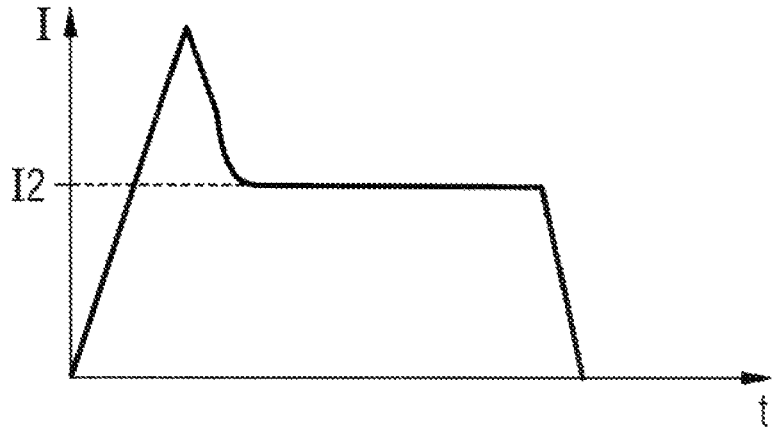

FIG. 2A and FIG. 2B show a current I which may be a driving current of the solenoid drive 34. However, the driving current of the solenoid drive 34 can also differ from the current I. In both Figures the current I increases with a high slope and then declines until it equals a first threshold I1 in FIG. 2A and a second threshold I2 in FIG. 2B respectively. The resulting peak of the current I enables a quick response of the solenoid drive 34.

Figure 3:
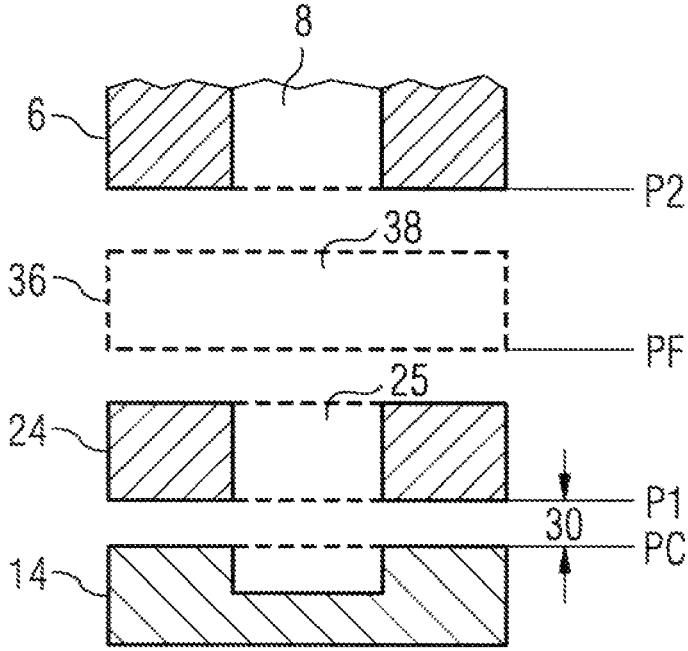
FIG. 3 different possible positions of a valve needle in the fluid injector, FIG. 4 an inner section of the fluid injector.
Figure 4:
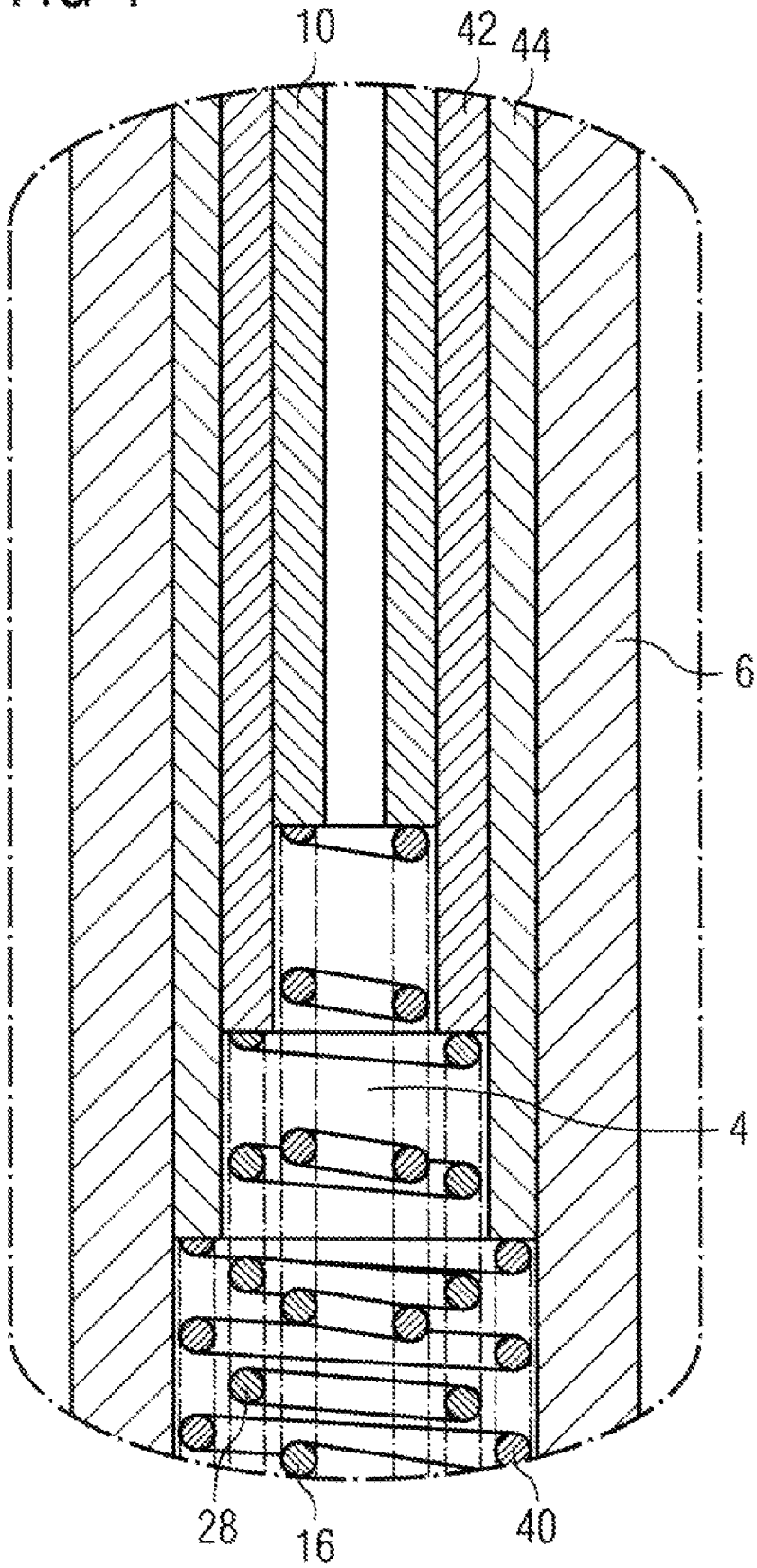

The first threshold I1 corresponds to a lift of the valve needle 12 and the first armature 14 from a closing position PC to a first given Position P1 (FIG. 3). When the solenoid drive 34 is actuated according to the current I shown in FIG. 2A, the valve needle 12 and the first armature 14 move axially away from the injection nozzle 18 until the initial first gap 21 between the first armature 14 and the second armature 24 is bridged. When the lift of the valve needle 12 and the first armature 14 equals the height of the initial first gap 21, the first armature 14 couples mechanically to the second armature 24. Due to the higher preload of the second spring 28 in comparison to the first spring 16 the second armature 24 is not lifted but remains static in its initial position mechanically coupled to the protrusion 26.

The second threshold I2 (FIG. 2B) corresponds to a lift of the valve needle 12 and the first armature 14 which equals the sum of the first gap 30 and the second gap 32. When the solenoid drive 34 is actuated according to the current I shown in FIG. 2B, the force being exerted on the second armature 24 is sufficiently high to overcome the force which is exerted by the preloaded second spring 28. As a result, the valve needle 12 and the first armature 14 are lifted until the first armature 14 couples mechanically to the second armature 24 and then the second armature 24, the valve needle 12 and the first armature 14 are lifted until the second armature 24 couples mechanically to the inlet tube 6.

Dependent on the current I the solenoid drive 34 can be actuated such that either a smaller or a bigger quantity of fluid can be dosed through the injection nozzle 18. However, due to the discrete lifts with their respectively given height, the dosed quantity of the fluid is precisely determinable in both cases.

In an embodiment, the valve body 2 comprises at least one further protrusion and at least one further armature 36 with a respective further cavity 38 is arranged in the recess 4 being coupled to an axial end of a preloaded respective further spring 40 such that it couples to the respective further protrusion. It may for example also be possible to have a multitude of further armatures 36 being arranged in the recess 4. In an embodiment the preload of the respective further spring 40 is bigger than the preload of the second spring 28.

FIG. 3 shows a schematic drawing of the further armature 36 being arranged in the recess 4 between the inner tube 6 and the second armature 24. Below the second armature 24, the first armature 14 is arranged. Any respective further armature 36 increases the number of possible opening positions of the valve needle 12 in which fluid is dosed through the injection nozzle 18. In the following it will be referred to the further armature 36 although it may be possible to have a multitude of further armatures 36 in the recess 6. In order to have the choice concerning the actuation of the valve needle 18 between the first given position P1, a further given position PF and the second given position P2, a further threshold for the current I is to be given. The further threshold has to be big enough that the resulting force on the first armature 14, the second armature 24 and the further armature 36 is bigger than the preload of the further spring 40.

FIG. 3 shows an inner section of the fluid injector with the inlet tube 6 and a multitude of adjusting tubes 10,42,44 in the recess 4 preloading the springs. The adjusting tube 10 preloads the first spring 16. A second adjusting tube 42 preloads the second spring 28 and a further adjusting tube 44 preloads the further spring 40. The preload is given individually for each of the springs 16,28,40 by a respective position of the respective adjusting tube 10,42,44.

What is claimed is:

1. A fluid injector comprising:

a valve body having a recess, a valve needle being arranged axially movable in the recess preventing a fluid flow out of an injection nozzle which extends away from the recess in a closing position and enabling the fluid flow of the injection nozzle apart from the closing position and being mechanically coupled to an axial end of a first spring which is preloaded to exert a force on the valve needle towards the injection nozzle, a first armature mechanically coupled to the valve needle, a second armature arranged in the recess axially movable away and towards a protrusion of the valve body, and mechanically coupled to an axial end of a second spring which is preloaded to exert a force on the second armature, the first and second armature being arranged such that from a closing position of the valve needle to a first given position of the valve needle away from the closing position the first armature and the second armature are mechanically decoupled, and from the first given position of the valve needle to a position further away from the closing position, the first armature and the second armature are mechanically coupled, at least one adjusting tube arranged in the recess and configured to preload at least one of the first and second springs by a mechanical coupling, and a solenoid drive being designed and arranged to magnetically actuate the first armature and the second armature to move axially.

2. The fluid injector according to claim 1, wherein at least one further armature being arranged in the recess axially movable away and towards a respective further protrusion of the valve body, being mechanically coupled to an axial end of a respective further spring which is preloaded to exert a force on the at least one further armature, being arranged and designed such that from a closing position of the valve needle towards a respective further given position away from the closing position the first armature and the respective further armature are mechanically decoupled, and from the respective further given position on, further away from the first given position, the respective further armature and the first armature are mechanically coupled.

3. The fluid injector according to claim 1, wherein the at least one adjusting tube comprises a single adjusting tube configured to preload both the first spring and the second spring by a mechanical coupling.

4. The fluid injector according to claim 1, wherein the at least one adjusting tube comprises a first adjusting tube configured to preload the first spring, and a second adjusting tube configured to preload the second spring.

5. A method for operating a fluid injector comprising the steps of:

providing a valve body having a recess, arranging a valve needle axially movable in the recess preventing a fluid flow out of an injection nozzle which extends away from the recess in a closing position and enabling the fluid flow of the injection nozzle apart from the closing position and being mechanically coupled to an axial end of a first spring which is preloaded to exert a force on the valve needle towards the injection nozzle, coupling a first armature mechanically to the valve needle, arranging a second armature in the recess axially movable away and towards a protrusion of the valve body, coupling the second armature mechanically to an axial end of a second spring which is preloaded to exert a force on the second armature, arranging the first and second armature such that from a closing position of the valve needle to a first given position of the valve needle away from the closing position the first armature and the second armature are mechanically decoupled, and from the first given position of the valve needle to a position further away from the closing position, the first armature and the second armature are mechanically coupled, arranging at least one adjusting tube in the recess and configured to preload at least one of the first and second springs by a mechanical coupling, and magnetically actuating the first armature and the second armature to move axially by a solenoid drive.

6. The method according to claim 5, wherein at least one further armature being arranged in the recess axially movable away and towards a respective further protrusion of the valve body, being mechanically coupled to an axial end of a respective further spring which is preloaded to exert a force on the at least one further armature, being arranged and designed such that from a closing position of the valve needle towards a respective further given position away from the closing position the first armature and the respective further armature are mechanically decoupled, and from the respective further given position on, further away from the first given position, the respective further armature and the first armature are mechanically coupled.

7. The method according to claim 5, wherein the at least one adjusting tube comprises a single adjusting tube configured to preload both the first spring and the second spring by a mechanical coupling.

8. The method according to claim 5, wherein the at least one adjusting tube comprises a first adjusting tube configured to preload the first spring, and a second adjusting tube configured to preload the second spring.

9. A fluid injector comprising:

a valve body with a recess, a valve needle being arranged axially movable in the recess along a longitudinal direction and being mechanically coupled to an axial end of a first spring which is preloaded to exert a force on the valve needle towards an injection nozzle, a first armature mechanically coupled to the valve needle, a second armature arranged in the recess axially movable away and towards a protrusion of the valve body, and mechanically coupled to an axial end of a second spring which is preloaded to exert a force on the second armature, the first and second armature being operable such that from a closing position of the valve needle to a first given position of the valve needle away from the closing position the first armature and the second armature are mechanically decoupled, and from the first given position of the valve needle to a position further away from the closing position, the first armature and the second armature are mechanically coupled, and a solenoid drive operable to magnetically actuate the first armature and the second armature to move axially, wherein a portion of the first spring is located concentrically within a portion of the second spring such that the portion of the first spring overlaps the portion of the second spring in the longitudinal direction.

10. The fluid injector according to claim 9, wherein at least one further armature being arranged in the recess axially movable away and towards a respective further protrusion of the valve body, being mechanically coupled to an axial end of a respective further spring which is preloaded to exert a force on the at least one further armature, being arranged and designed such that from a closing position of the valve needle towards a respective further given position away from the closing position the first armature and the respective further armature are mechanically decoupled, and from the respective further given position on, further away from the first given position, the respective further armature and the first armature are mechanically coupled.

11. The fluid injector according to claim 9, wherein an adjusting tube is arranged in the recess and is designed to preload the first spring and the second spring by a mechanical coupling.

12. The fluid injector according to claim 9, wherein a first adjusting tube and a second adjusting tube are arranged in the recess such that adjusting tube preloads the first spring and the second adjusting tube preloads the second spring.

13. A fluid injector comprising:

a valve body with a recess, a valve needle being arranged axially movable in the recess along a longitudinal direction, a first armature mechanically in the recess and coupled to the valve needle, a second armature in the recess and separate from the first armature, the second armature axially movable towards and away from a first protrusion of the valve body, a third armature in the recess and separate from the first and second armatures, the third armature axially movable towards and away from a second protrusion of the valve body, a first spring mechanically coupled to the first armature, a second spring mechanically coupled to the second armature, and a third spring mechanically coupled to the third armature, wherein in a closed position of the valve needle, the first armature, the second armature, and the third armature are mechanically decoupled from each other, wherein in a first open position of the valve needle, the first armature and the second armature are mechanically coupled to each other, but mechanically decoupled from the third armature, and wherein in a second open position of the valve needle further in the open position than the first open position, the first armature, the second armature, and the third armature are mechanically coupled.

14. A fluid injector comprising:

a valve body with a recess, a valve needle being arranged axially movable in the recess along a longitudinal direction, a first armature mechanically in the recess and coupled to the valve needle, a second armature in the recess and separate from the first armature, the second armature axially movable towards and away from a protrusion of the valve body a first spring mechanically coupled to the first armature, a first spring being preloaded to exert a force on the valve needle towards an injection nozzle, a second spring mechanically coupled to the second armature, wherein in a closed position of the valve needle, the first spring biases the first armature but not the second armature, and the second spring biases the second armature but not the first armature, and wherein in a particular open position of the valve needle, the second spring biases both the first armature and the second armature, a solenoid drive operable to magnetically actuate the first armature and the second armature to move axially.

15. The fluid injector according to claim 14, wherein:

wherein in the closed position of the valve needle, the first armature and the second armature are mechanically decoupled, and wherein in the particular open position of the valve needle, the first armature and the second armature are mechanically coupled.

16. The fluid injector according to claim 14, further comprising an adjusting tube configured to preload the first spring and the second spring.

17. The fluid injector according to claim 14, further comprising a first adjusting tube configured to preload the first spring, and a second adjusting tube configured to preload the second spring.

* * * * *